US005154385A

United States Patent [19]

Lindberg et al.

[11] Patent Number: 5,154,385

[45] Date of Patent: Oct. 13, 1992

[54] SUPPORT SYSTEMS WITH IMPROVED CHANNEL NUTS

[75] Inventors: Verne L. Lindberg, Everett; George R. Todd, Woodinville, both of Wash.

[73] Assignee: George R. Todd, Woodinville, Wash.

[21] Appl. No.: 682,620

[22] Filed: Apr. 8, 1991

[51] Int. Cl.[5] ..... A47B 96/06

[52] U.S. Cl. ..... 248/225.1; 248/245; 248/297.2; 403/21

[58] Field of Search ..... 248/225.1, 223.3, 245, 248/243, 244, 246, 295.1, 297.2, 52, 62, 65, 70; 403/21

[56] References Cited

U.S. PATENT DOCUMENTS

| | | | |
|---|---|---|---|
| 576,939 | 2/1897 | Baines | 248/244 |
| 982,279 | 1/1911 | Knape | 248/244 |
| 1,668,953 | 5/1929 | Erickson . | |
| 2,164,991 | 12/1941 | Niedax . | |
| 2,273,571 | 2/1942 | Hafemeister . | |
| 2,345,650 | 4/1944 | Attwood | 403/21 |
| 2,569,622 | 10/1951 | Trainor | 248/297.2 X |
| 3,042,352 | 7/1962 | Stamper . | |
| 3,132,609 | 5/1964 | Chesley | 248/297.2 X |
| 3,132,831 | 5/1964 | Stamper . | |
| 3,226,069 | 12/1965 | Clarke . | |
| 3,527,432 | 9/1970 | Lytle . | |
| 3,565,385 | 2/1971 | Zurawski . | |
| 3,650,499 | 3/1972 | Biggane . | |
| 3,847,489 | 11/1974 | Van Riper | 248/297.2 X |
| 4,013,253 | 3/1977 | Perrault et al. | 248/223.3 |
| 4,417,711 | 11/1983 | Madej . | |
| 4,695,019 | 9/1987 | Lindberg et al. . | |
| 4,895,331 | 1/1990 | Nehls | 248/297.2 X |
| 4,961,553 | 10/1990 | Todd | 248/62 |

*Primary Examiner*—Ramon O. Ramirez
*Attorney, Agent, or Firm*—Hughes & Multer

[57] ABSTRACT

Systems for supporting loads which includes an elongated strut (or channel). A load-supporting component is fixed to the channel at a selected location therealong by a faster threaded into an associated channel nut. The channel nut is easily and quickly installed in the channel through a gap between flanges paralleling and spaced inwardly from the side walls of the channel and then rotated (and displaced along the channel, if necessary) to seat a lug on the nut in cooperating notches formed opposite each other in the flanges of the channel. This interfitting relationship provides a positive connection between the channel nut and the channel, keeping even heavy loads and loads subjected to vibration, hammering, or the like from slipping, even if the supporting channel is vertically oriented and the load is therefore the most susceptible to slippage. A double helical coil spring with biases the channel nut lug toward the bottoms of the notches to keep the channel nut in place until the load supporting component is assembled to the channel nut with the threaded fastener to lock the channel nut in place.

30 Claims, 2 Drawing Sheets

SUPPORT SYSTEMS WITH IMPROVED CHANNEL NUTS

TECHNICAL FIELD OF THE INVENTION

In one aspect, the present invention relates to novel, improved systems for supporting pipes, conduits, and other loads.

And, in another aspect, the present invention relates to novel, improved channel nuts for such systems.

BACKGROUND OF THE INVENTION

A number of systems for supporting pipes and other components from elongated, U-section components variously termed struts and channels have heretofore been proposed. Systems of the foregoing character are disclosed in U.S. Pat. Nos.: 1,668,953 issued May 8, 1928, to Erickson for MOLDING FOR ELECTRIC CABLES; U.S. Pat. No. 2,273,571 issued Feb. 17, 1942, to Hafemeister for PIPE HANGER; U.S. Pat. No. 3,042,352 issued Jul. 3, 1962, to Stamper for PIPE HANGER; U.S. Pat. No. 3,132,831 issued May 12, 1964, to Stamper for CLIP-ON PIPE HANGER; U.S. Pat. No. 3,226,069 issued Dec. 28, 1965, to Clarke for HANGER FOR CYLINDRICAL CONDUITS AND THE LIKE; U.S. Pat. No. 3,527,432 issued Sep. 8, 1970, to Lytle for PIPE OR TUBING SUPPORT; U.S. Pat. No. 3,565,385 issued Feb. 23, 1971, to Zurawski for FLUORESCENT TUBE BOX SUSPENSION SYSTEM AND MEANS; U.S. Pat. No. 3,650,499, issued Mar. 21, 1972, to Biggane for CLAMP FOR PIPE SUPPORT WITH SLANTING PIVOTAL ASSEMBLY; U.S. Pat. No. 4,417,711 issued Nov. 29, 1983, to Madej for PIPE HANGER; and U.S. Pat. No. 4,695,019 issued Sep. 22, 1987, to Lindberg et al. for NON-METALLIC STRUT SYSTEM and in: Offenlegungsschrift No. 2164991 filed 28 Dec. 1971 by Niedax Ges. F. Verlegungsmaterial mbH and laid open to public inspection on 12 Jul. 1973 and a Spring 1987 catalog from Aickinstrut, Inc., P.0. Box 569, Redmond, Wash. 98073.

Systems of the type disclosed in the foregoing patents and the Aickinstrut catalog with surface mounted struts or channels have been in use for over fifty years to support pipes, electrical raceways, and other system components form the floors, walls, and ceilings of buildings and from other structures. The struts or channels of the system are attached to the structure; and clamps, connectors, and other fittings are employed to attach the supported component (or load) to the channels or struts.

In a typical, heretofore proposed system with metal components, there is a simple frictional fit between the supporting strut or channel and the fixture installed in that channel to support a load from it (see, for example, above-cited patents U.S. Pat. Nos. 3,226,069; 3,527,432; 3,565,385; 3,650,499; and 4,417,711). With non-metallic, engineered polymers substituted for the heretofore utilized metallic components (see, as an example, above-cited U.S. Pat. No. 4,695,019), this approach proves somewhat less than satisfactory. Due to the much lower coefficients of friction, the load-supporting fixture can easily slip along the supporting strut or channel when a polymer is substituted for metal in a conventional support system design, allowing the load to shift. This is especially true in applications in which the supporting channels are vertically oriented, particularly if the load is relatively heavy or subjected to vibration or hammering and because the pipe runs are often then employed as ladder rungs. Shifting loads are of course very undesirable as they radically increase the potential for system failure.

U.S. Pat. No. 4,961,553 issued 9 Oct. 1990 to Todd for SUPPORT SYSTEMS FOR PIPES AND OTHER LOADS and copending U.S. patent application No. 07/558,581 filed 27 Jul. 1990 by Todd et al. for SUPPORT SYSTEMS AND COMPONENTS THEREOF disclose novel, improved support systems designed for the applications just described. These support systems generally include elongated struts or channels and clamps, connectors, and other fittings for attaching a load to the supporting channel. The system components may be fabricated of non-metallic materials. This makes the novel systems disclosed in the just-cited patent and application appropriate for even highly corrosive environments. At the same time, the system components are simple and relatively inexpensive to manufacture; and the resulting systems are accordingly sufficiently cost effective to be employed in even the most mundane of applications.

Perhaps most prominent among the novel features of these previously disclosed systems is the type of supporting channel which is employed. Like conventional channels, those employed in the previously disclosed systems have a U-shaped cross-section. However, there are notches in and spaced along these channels in which the load-supporting fittings can be engaged to keep the load from shifting, even in demanding applications in which the channels are vertically oriented and the loads are heavy or of a nature which causes hammering or vibration. These notches are formed in the rearmost, free or exposed edges of flanges which are integral with, and spaced inwardly from, the side walls of the channels.

One consequence of this novel construction is that the load-supporting capacity of the channel is dramatically increased. Even though the polymeric material from which it is fabricated may have lower shear strength than steel, much thicker and variable sections are practical. A second, also significant, advantage of these channels is that channel nuts and other trapped-type fittings can be employed, greatly increasing the versatility of the channel by increasing the types of fittings which may be employed with it. At the same time, and because they are fabricated from non-metallic materials, the channels under discussion can be supplied at competitive costs whereas they could not be, if fabricated from metal as previously disclosed, notched, support system channels are.

Heretofore, support systems with conventional, unnotched channels have employed metallic and non-metallic internal fittings such as channel nuts which are retained in place by friction. Particularly in systems employing non-metallic channels with their lower coefficients of friction, this approach is not without its disadvantages. Available channel nuts are relatively expensive; and large numbers of these components (typically four per foot) are required. Therefore, in a typical installation, systems employing unnotched non-metallic channels and channel nuts are not competitive unless corrosion problems are severe and support systems with metallic components can not be employed. As a corollary, such systems are typically not competitive because of the additional labor required to install them. Furthermore, even closely spaced, the channel nuts of such systems often do not provide adequate resistance to the shifting of loads in onerous applications—e.g., those involving hammering or vibrating and vertically oriented channels.

Load shifting is certainly minimized, if not eliminated, in the notched channel, non-metallic systems disclosed in the Todd patent and Todd et al. application. In these systems, positive engagement of the channel nuts in the notches of the channels keeps the channel nuts and supported loads from shifting along the channels in even the most demanding of applications. However, those Todd and Todd et al. systems employing channel nuts do have their disadvantages.

One is that they are not easily installed in a channel in that these previously disclosed channel nuts must be loaded into an end of the channel and then displaced to the wanted location. This is unwieldy if the channel is of any length and may be totally impractical if the ends of the channel are not accessible or if other load-supporting components have previously been installed between the accessible end or ends of the channel and the location where the channel nut is wanted.

Another disadvantage of the Todd and Todd et al. channel nuts is that no provision is made for retaining these channel nuts in the wanted locations while load-supporting components are being attached to them. Thus, unless the installer manually holds the channel nut in place, it is apt to slip out of the channel notches in which it is seated at the wanted location, particularly in those systems in which the channels are vertically oriented. This requirement for manual intervention by the installer slows the process of assembling the system, increasing its cost and making installers less willing to employ the system.

SUMMARY OF THE INVENTION

There have now been invented, and disclosed herein, certain new and novel channel-based, load-supporting systems with channel nuts which obviate the disadvantages of such systems having the heretofore proposed components of that character.

In general, the channel nuts disclosed herein differ from many of those heretofore proposed in that they are designed to fit into paired notches formed in the flanges of a channel in which they are to be installed at a selected location therealong. This results in a positive engagement between the channel and the channel nut, keeping the nut, the load-supporting component attached to the nut, and the load supported by that component from shifting along the channel, even in the worse case in which the channel is vertically oriented and the load is subjected to exacerbated vibration or hammering.

Furthermore, the channel nuts disclosed herein differ from those found in the above-cited Todd patent and Todd et al. application by the virtue of the fact that they are so configured that: (1) they can be installed through the gaps between the flanges of the channel, (2) then rotated through an angle of approximately 90° to orient notch-engaging lugs on the nuts so that they can be fitted into notches in the channel, and (3) then displaced along the channel, if necessary, to align the lugs with the slots at the location wanted for the channel nut. This reduces to the simplest level possible the process of installing channel nuts in the load-supporting channel of those systems of the character under discussion.

The novel channel nuts disclosed herein also differ from those which are the subject of the above-cited patent and application in that a dual coil spring or other biasing component is provided on that side of the nut opposite the notch-engaging lugs. This component is compressed during the installation of the channel nut in the manner just described. Once the nut is rotated, rectilinearly displaced as necessary, and seated in the wanted notches in the channel flanges, this biasing component restores toward its original configuration, biasing the lugs on the nut against the bottoms of the notches in which the lugs are seated. This ensures that the nut remains in the wanted location while the load-supporting component is being assembled to the nut without intervention by the installer. Thus, the process of assembling the system is speeded up to a considerable extent, and the installation process is made significantly more palatable to the installer.

Still another significant advantage of the novel channel nuts disclosed herein is that the entire component, including the notch-engageable lugs and the biasing spring can be fabricated as a single component, typically by molding it from an appropriate engineered polymer. This is particularly important from the viewpoint of cost. Also, this preferred fabrication of the channel nut from an engineered polymer makes a significant contribution to the corrosion resistance of the system in which it is incorporated.

OBJECTS OF THE INVENTION

From the foregoing, it will be apparent to the reader that one important and primary object of the present invention resides in the provision of novel, improved systems of the character which utilize struts and channels and load supporting components attached thereto by one or more channel nuts installed in the channel(s) of the system.

Related and also important but more specific objects of the invention are systems of the character identified in the proceeding object:

which are relatively easy and correspondingly inexpensive to assemble;

which are capable of keeping supported loads from shifting, even in demanding applications;

which are capable of being employed in corrosive environments;

which have the other advantages of the related systems disclosed in above-cited U.S. Pat. No. 4,916,553 and application No. 07/558,581.

Still another important and primary object of the invention is the provision of novel, improved channel nuts for load-supporting systems as characterized in the preceding objects.

Related and also important, albeit more specific, objects of the invention reside in the provision of channel nuts as described in the preceding object:

which can be inexpensively fabricated in one piece from an appropriate, corrosion resistant polymer;

which are extremely easy to install;

which are so designed as to remain in place without intervention by an installer while load-supporting components are assembled to them;

which, once the load-supporting component is attached, are locked to the channel(s) in which they are installed, thus positively keeping the supported load or loads from shifting relative to the supporting channel(s).

Other important objects, features, and advantages of the invention will be apparent to the reader from the foregoing and the appended claims and from the ensuing detailed description and discussion of the invention taken in conjunction with the accompanying drawing.

DETAILED DESCRIPTION OF THE INVENTION

Figures 1, 1A, 2:
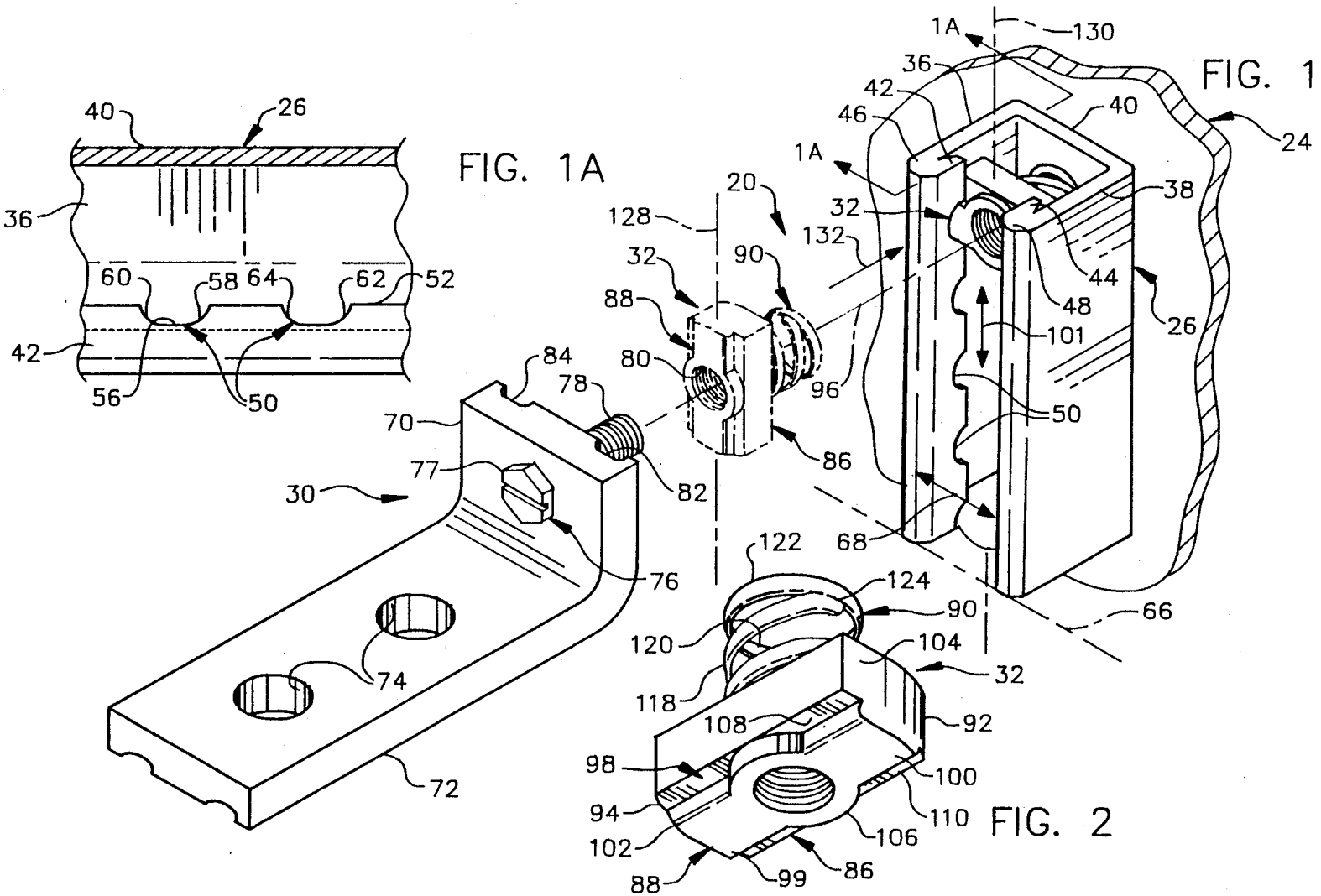
FIG. 1 is an exploded view of a support system constructed in accord with the principles of the present invention.
FIG. 1A is a fragmentary section through a load-supporting channel employed in the system of FIG. 1, looking generally in the direction indicated by arrows 1A—1A.
FIG. 2 is a pictorial view of a novel channel nut which also embodies the principles of the present invention and is particularly intended for systems of the character shown in FIG. 1.
Figure 3:
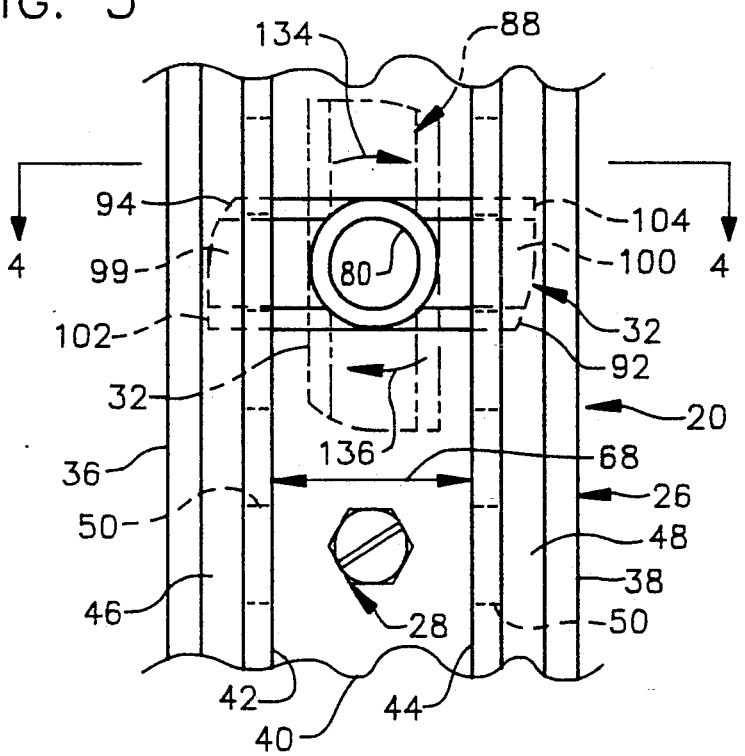
FIG. 3 is a view of the support system with the channel nut installed.

Referring now to the drawing, FIGS. 1 and 3 depict a system 20 for supporting a load (not shown) from a static structure represented in FIG. 1 by a vertically extending stud 24. System 20 is constructed in accord with, and embodies, the principles of the present invention.

The major components of load supporting system 20 are: (a) a rigid, elongated strut or channel 26, which is fixed to stud 24 as by lag bolts (a representative lag bolt is shown in FIG. 3 and identified by reference character 28); (b) an L-shaped bracket 30 for supporting the load from channel 26; and (c) a channel nut 32 which: is constructed in accord with the principles of the present invention, is installed in channel 26, and locks bracket 30 to channel 26 at a selected location therealong. Thus, system 20 prevents unwanted, and potentially disastrous, shifting of bracket 30 and the supported load relative to the stud 24 to which channel 26 is attached.

Strut 26 has a U-shaped configuration (see FIGS. 1 and 4); and it has integral side and back walls 36, 38, and 40 with the side walls parallel and the back wall meeting the side walls at right angles. Spaced inwardly from channel side walls 36 and 38 are integral flanges 42 and 44. These extend from the forward edges of channel side walls 36 and 38 toward the rear wall 40 of the channel. Flanges 42 and 44 parallel the side walls 36 and 38 of the channel and are connected to the adjacent side walls by integral, transversely extending channel portions 46 and 48.

Elongated notches 50 of uniform shape and size are formed in, and spaced equidistantly along, the inner flanges 42 and 44 of channel 26. These notches or recesses 50 open onto the rear wall facing, free edges 52 and 54 of channel flanges 42 and 44.

Each notch 50 has a bottom 56 and ends 58 and 60. Integral, arcuate transition sections—or rounded corners—62 and 64 respectively join the ends 58 and 60 of each notch 50 to its bottom 56.

In one typical application of the present invention, channel 26 is fabricated from a glass filled polypropylene (PPE) or polyvinylchloride (PVC). Side and back walls 36, 38, and 40 are approximately 0.125 in thick (that dimension and those which follow are nominal). The facing, side wall and flange surfaces taper at angles of 5° and 10° beginning at a point 0.813 in from the front edge 66 of the channel. This thickens and strengthen channel side walls 36 and 38. The outer side wall and flange surfaces are tapered at an angle of 60° relative to front edge 66, leaving surface segments at that edge which are 0.188 in wide. Fifty thousandth inch radius fillets join side walls 36 and 38 to flanges 42 and 44; and the gap 68 between flanges 42 and 44 is 0.750 in wide.

This representative channel 26 is 1.625 in wide and 1.625 in or 1.125 in deep. Notches 50 are 0.125 in deep and 0.500 in long and are spaced 0.500 in apart along flanges 42 and 44 with the notches in the two flanges paired and located opposite each other. The radii of the transition sections 62 and 64 joining the notch ends 58 and 60 to bottom or inner edge 56 of each notch 50 are 0.188 in maximum. Notches 50 are relatively easy and inexpensive to mill or otherwise generate. The radii are large enough to eliminate stress concentrations at the ends of the notches and to provide large areas of stress distributing surface-to-surface contact between the channel and canted load-attaching fittings as well as those which are normally oriented.

L-shaped bracket or connector 30 has two integral legs 70 and 72 disposed at right angles to each other. Apertures 74 through leg 72 accommodate fasteners (not shown). Those are employed to attach a supported component or load to connector 30.

The second, integral leg 70 of connector 30 is fixed to the side walls 36 and 38 of channel 26 by a headed fastener 76. The head 77 of fastener 76 abuts bracket leg 70. The shank 78 of this fastener extends through an aperture (not shown) in connector leg 30 and is threaded into the internally threaded, centrally located aperture 80 of channel nut 32.

The channel-associated leg 70 of load-supporting bracket 30 is somewhat wider than channel 26. It thus spans the gap 68 between channel flanges 42 and 44 and can be engaged with the integral, transition sections 62 and 64 at opposite sides of the channel.

Parallel grooves 82 and 84 in the channel-associated leg 70 of bracket 30 match the configuration of, and receive, the channel transition sections 62 and 64. This eliminates the problem of orienting bracket 30 with respect to channel 26 when the bracket is assembled to the channel.

Bracket 30 can also be fabricated from a glass filled PPE or PVC in the interest of corrosion resistance.

Referring still to the drawing, channel nut 32 includes a monolithic body 86, a lug 88 which is engageable in a selected pair of the notches 50 in channel 26, and biasing mechanism 90. The latter holds channel nut 32 in place with lug 88 seated in the selected pair of notches 50 while a load-supporting component such as bracket 30 is being assembled to the channel nut. In preferred embodiments of the invention, body 86, lug 88, and biasing mechanism 90 are all integral parts of the same channel nut 32.

The body 86 of channel nut 32 has a generally parallelepipedal configuration with diametrically opposed corners 92 and 94 of the body rounded (see FIG. 3) to facilitate the rotation of the channel nut in channel 26 in the course of installing the channel nut. Internally threaded aperture 80 is formed in this component of the channel nut and is centered on its transverse centerline 96.

Integral lug 88 protrudes from the front face 98 of channel nut body 86. The lug has a generally rectangular cross-sectional configuration complementing the notches 50 in flanges 42 and 44 of channel 26 (see FIG.

1). With the end segments 99 and 100 of lug 88 seated in the notches 50 of a selected pair, this keeps channel nut 32 and loads supported by bracket 30 from shifting longitudinally relative to load-supporting channel 26; i.e., in one of the two directions indicated by arrow 101 in FIG. 1.

To ensure maximum channel nut-to-channel contact, lug 88 is preferably dimensioned to extend from one end 102 of channel nut body 86 to its other end 104. Intermediate its ends, the lug has an arcuate segment 106 surrounding internally threaded aperture 80 and providing resistance to breaking in this area. Also, as can best be seen in FIGS. 1 and 2, lug 88 is narrower than the face 98 of channel nut body 86 from which it protrudes. This leaves exposed flats 108 and 110. Those flats engage the rear, free ends 52 and 54 of channel flanges 42 and 44 when channel nut 32 is seated with the segments 99 and 100 at the opposite ends of lug 88 in the respective notches 50 of a selected notch pair.

As is best shown in FIGS. and 4, the mechanism 90 which keeps channel nut 32 in place while a load-supporting component such as bracket 30 is assembled to it extends from the rear face 116 of channel nut body 86 to the rear wall 40 of the channel 26 in which a particular channel nut 32 is installed. This mechanism is made up of helical springs 118 and 120 and an integral, ring 122. This arrangement of dual helical springs results in biasing mechanism 90 exerting uniform pressure on the opposite sides of the channel nut main body 86. That eliminates any tendency of the channel nut to tip in the notches 50 in which channel nut lug 88 is seated. As a result, the channel nut is securely seated at the desired location along channel 26; and aperture 80 is aligned along centerline 96, making it a simple task to thread fastener 76 into that aperture.

Figure 4:
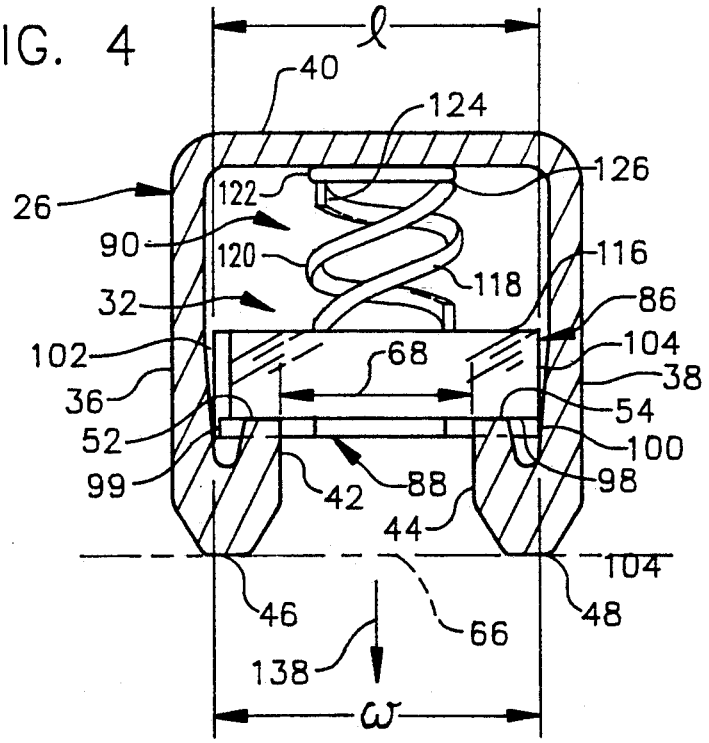
FIG. 4 is a section through FIG. 3, taken substantially along FIG. 4—4 of the latter.

As is best in shown in FIGS. 2–4, ring 122 of biasing mechanism 90 is integrated with the free ends 124 and 126 of helical springs 118 and 120. Thus, integral ring 122 ties together the free ends 124 and 126 of the helical springs. Also, it uniformly distributes over the back wall 40 of channel 26 the forces exerted on that segment of the channel by the helical springs. This further minimizes the possibility that the main body 86 and lug 88 of the channel nut 32 might tip in the notches 50 in which the lug is seated.

Channel nut 32 can be injection molded from an appropriate thermoplastic polymer by employing a split mold and an associated core. Thus, an integral, damage resistant, structurally stable channel nut can be easily and inexpensively fabricated at a relatively low cost.

Materials from which the channel nut may be thus fabricated include vinyl chloride, acetal, and urethane polymers filed with glass and other reinforcements.

Referring now primarily to FIGS. 1 and 3, it was pointed out above that ease of installation is a salient, important feature of the channel nut 32 just described. Installation is effected by orienting the channel nut 32 with its major axis 128 extending in the same direction as the major axis 130 of channel 26 and with the channel nut opposite the gap 68 between the flanges 42 and 44 of the channel 26 in which the channel nut is to be installed as is shown in broken lines in FIG. 1. The channel nut is then displaced in the direction indicated by arrow 132 in FIG. 1 until the main body 86 of the channel nut, which is narrower than gap 68, clears the free, rear edges 52 and 54 of channel flanges 42 and 44. As this occurs, biasing mechanism ring 122 engages the rear wall 40 of channel 26, and dual helical coil springs 118 and 120 are compressed (see FIG. 1).

Next, the channel nut is rotated through an angle of approximately 90° as indicated by arrows 134 and 136 in FIG. 3, aligning the end segments 99 and 100 of channel nut lug 88 transversely in channel 26 and trapping the channel nut bearing flanges 42 and 44. This rotation of the channel nut is facilitated by biasing mechanism ring 122 and by the above-discussed rounded corners 92 and 94 on the channel nut main body 86. Also, the length "l" of the channel nut main body is so related to the distance "w" between the side walls 36 and 38 of channel 26 that the channel nut cannot be rotated through significantly more than the 90° arc need to align lug 88 for seating in a selected pair of channel notches 50 which further simplifies the installation of the channel nut.

Once channel nut 32 has been rotated to the orientation shown in solid lines in FIG. 3, it is shifted longitudinally of the channel—i.e., in the one of the directions indicated by arrow 101 in FIG. 1—if necessary to position the end segments 99 and 100 of lug 88 opposite that pair of notches 50 in which the lug is to be seated.

Then, the installer releases his grip on the channel nut. Thereupon, helical springs 118 and 120 restore toward their relaxed configurations. This generates forces which act in the direction indicated by arrow 138 in FIG. 4, seating channel nut lug 88 in the selected channel notches 50 and keeping the channel nut firmly seated while bracket 30 is assembled to it.

Because friction is not relied upon to keep the channel nuts disclosed herein from slipping with respect to the channels in which they are installed, the contact between the ends of the nut and the channel walls heretofore relied upon to provide increased resistance to slippage is unnecessary. This ability to leave gaps between the ends of the channel nut and the associated channel side walls of course makes it possible to rotate the channel nut in the manner just described to orient its notch-associated lugs with the notches in the channel.

Finally, the load-supporting bracket 30 or other load-supporting component is assembled to channel 26 with channel nut 32 and the associated, headed fastener 76. In particular, the shank 78 of the fastener is extended through the aperture in the channel-associated leg 70 of bracket 30 and threaded into the internally threaded aperture 80 of channel nut 32. As fastener 76 is then rotated, this draws the channel nut and bracket together until: (a) the integral, transversely extending segments 46 and 48 of the channel are seated in the grooves 82 and 84 of bracket 30, and (b) the channel nut is locked in place with the ends 99 and 100 of its lug 88 seated in the selected notches 50 in channel flanges 42 and 44. Thus locked to the channel, the channel nut 32 cannot slip; and the load thereafter connected to and supported by bracket 30 cannot shift relative to the channel in either of the arrow 101 directions.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed as the invention is:

1. A support system comprising: an elongated channel, a component for supporting a load from said channel, a channel nut in said channel for locking the load supporting component to the channel at a selected location therealong, and means for connecting said load-supporting component to said channel nut, said channel having spaced apart side walls, a back wall spanning said side walls, flanges which are spaced inwardly from said side walls with a gap therebetween and have free edges facing said back wall, and oppositely positioned, paired notches formed in and opening onto the free edges of said flanges at intervals therealong, and said channel nut having: lug means seatable in those notches making up a selected pair of notches to thereby position said channel nut and the load-supporting component connected to it at a selected location along the channel and means biasing said channel nut lug means into said notches to thereby retain said channel nut in place until the connection between the load-supporting component and the channel nut is made.

2. A support system as defined in claim 1 in which the channel of the support system has a series of paired notches as aforesaid, all of said notches being of similar dimensions and configuration and the spacing between successive pairs of notches being the same.

3. A system as defined in claim 1 in which the load supporting component has a segment of sufficient width to span the gap between said flanges and engage said channel on opposite sides thereof, there being an aperture through said segment and said connecting means extending through said aperture into threaded engagement with the channel nut so that rotation of said fastener relative to said channel nut will draw said nut toward said load-supporting component and lock said channel nut to said channel.

4. A system as defined in claim 1 in which the length of the channel nut is so related to the distance between the side walls of the channel and the width of the gap between the flanges that said nut can be aligned with and installed in said channel through said gap, then rotated to trap the channel nut behind said flanges, and then displaced along the channel as necessary to seat said nut in a selected pair of the notches in said flanges.

5. A system as defined in claim 4 in which the length of the channel nut is so related to the distance between the channel side walls as to limit the rotation of the channel nut in the channel from the orientation in which it is aligned with the gap between the channel flanges to approximately 90° so that maximum rotation of the channel nut will align the channel nut lug means with the notches in the flanges of the channel.

6. A system as defined in claim 1 in which the channel nut has a main body portion and said biasing means and said lug means are integral with said main body position.

7. A system as defined in claim 1 in which the biasing means of the channel nut is comprises dual helical coil springs.

8. A system as defined in claim 7 in which the channel nut has a main body portion and the helical coil springs are integral with the main body portion.

9. A system as defined in claim 7 in which the helices of the biasing means extend to adjacent the back wall of the channel and the channel nut has an integral component for joining the free ends of the springs together and for distributing the load exerted by the biasing means on the back wall of the channel.

10. A support system comprising: an elongated channel, a component for supporting a load from said channel, a channel nut in said channel for locking the load supporting component to the channel at a selected location therealong, and means for connecting said load-supporting component to said channel nut, said channel having spaced apart side walls, a back wall spanning said side walls, and flanges which are spaced inwardly from said side walls with a gap therebetween and have free edges facing said back wall and oppositely positioned, paired notches formed in and opening onto the free edges of said flanges at intervals therealong and said channel nut having lug means seatable in those notches making up a selected pair of notches to thereby position said channel nut and the load-supporting component connected to it at a selected location along the channel, the distance between the side walls of the channel and the width of the gap between the flanges being so related that said nut can be installed in said channel, aligned with and displaced through gap, rotated to trap the channel nut behind said flanges, and displaced along the channel as necessary to seat said lug means in a selected pair of the notches in said flanges.

11. A system as defined in claim 10 in which the length of the channel nut is so related to the distance between the channel side walls as to limit the rotation of the channel nut in the channel from the orientation in which it is aligned with the gap between the channel flanges to approximately 90° so that maximum rotation of the channel nut will align the channel nut lug means with the notches in the flanges of the channel.

12. A support system as defined in claim 10 in which the channel of the support system has a series of paired notches as aforesaid, all of said notches being of similar dimensions and configuration and the spacing between successive pairs of notches being the same.

13. A system as defined in claim 10 in which the load supporting component has a segment of sufficient width to span the gap between said flanges and engage said channel on opposite sides thereof, there being an aperture through said segment and said connecting means extending through said aperture into threaded engagement with the channel nut so that rotation of said fastener relative to said nut will draw said channel nut toward said load-supporting component and lock said channel nut to said channel at the selected location therealong.

14. A system as defined in claim 10 in which the channel nut has a main body portion and said biasing means and said lug means are integral with said main body portion.

15. A system as defined in claim 10 in which the biasing mean of the channel nut comprises dual helical coil springs.

16. A system as defined in claim 15 in which the channel nut has a main body portion and the helical coil springs are integral with the main body portion.

17. A system as defined in claim 15 in which the helical coil springs of the biasing means extend to adjacent the back wall of the channel and the channel nut has a integral component for joining the free ends of the springs together and for distributing the load exerted by the biasing means on the back wall of the channel.

18. A channel nut which is adapted to: (a) be installed in a channel having spaced apart side walls, a back wall spanning said side walls, flanges which are spaced inwardly from said side walls and have free edges facing said back wall with a gap therebetween and oppositely positioned, paired notches in and opening onto the free edges of said flanges at intervals therealong, and (b) receive a threaded fastener and thereby secure an associated load-supporting component to said channel at a selected location therealong, said channel nut comprising: a main body portion; lug means on one side of the main body portion, said lug means being configured to fit into those notches in a selected pair thereof; and means extending from the opposite side of the channel nut for biasing said lugs toward the bottoms of the notches in which they are seated, thus keeping the channel nut in the selected location relative to the channel as the load-supporting component is attached to the channel with said fasteners.

19. A channel nut as defined in claim 18 which is fabricated from an engineered polymer.

20. A channel nut as defined in claim 18 in which the biasing means and the lug means are integral with the main body portion of the channel nut.

21. A channel nut as defined in claim 20 which is fabricated from an engineered polymer.

22. A system as defined in claim 18 in which the biasing means of the channel comprises dual helical coil springs.

23. A system as defined in claim 22 in which the coil springs are integral with the main body portion of the channel nut.

24. A system as defined in claim 23 in which the biasing means coil springs are adapted to extend to adjacent the back wall of the channel in which the channel nut is installed and the channel nut has an integral component for joining together those ends of the biasing means removed from the channel nut main body portion and for distributing the load exerted by the biasing means on the back wall of the channel.

25. A channel nut as defined in claim 24 in which the end joining and load distributing means has a circular, ringlike configuration.

26. A channel nut as defined in claim 18 in which the end joining and load distributing means is integral with the biasing means coil springs at the free ends thereof.

27. A channel nut as defined in claim 18 in which the cross-section of the lug means is configured to complement the notches in the channel in which the nut is installed.

28. A channel nut as defined in claim 18 in which diametrically opposed corners of the main body portion are rounded to facilitate the rotation of the nut in a channel in which the nut is installed.

29. A channel nut as defined in claim 18 which has a single lug means, said lug means extending from end-to-end of the main body portion of the nut.

30. A channel nut as defined in claim 18 which has a centrally located, internally threaded aperture for a fastener with complementary threading.

* * * * *